US012146263B2

(12) United States Patent
Kennedy et al.

(10) Patent No.: US 12,146,263 B2
(45) **Date of Patent: *Nov. 19, 2024**

(54) DEWATERING BOX COVER

(71) Applicant: First Quality Tissue, LLC, Great Neck, NY (US)

(72) Inventors: Theodore D. Kennedy, San Mateo, FL (US); Donald Kenneth Zimmerman, Howard, PA (US)

(73) Assignee: First Quality Tissue, LLC, Great Neck, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/336,694

(22) Filed: Jun. 2, 2021

(65) Prior Publication Data

US 2021/0372049 A1 Dec. 2, 2021

Related U.S. Application Data

(60) Provisional application No. 63/033,295, filed on Jun. 2, 2020.

(51) Int. Cl.

| | |
|---|---|
| ***D21C 9/18*** | (2006.01) |
| ***D21F 1/00*** | (2006.01) |
| ***D21F 7/12*** | (2006.01) |

(52) U.S. Cl.

CPC ..... *D21C 9/18* (2013.01); *D21F 1/0027* (2013.01); *D21F 7/12* (2013.01)

(58) Field of Classification Search

CPC . D21C 9/18; D21F 1/0027; D21F 7/12; D21F 1/523

See application file for complete search history.

(56) References Cited

U.S. PATENT DOCUMENTS

| | | | | |
|---|---|---|---|---|
| 3,428,521 A * | 2/1969 | Andre | D21F 1/52 | 162/366 |
| 4,909,906 A * | 3/1990 | Bartelmuss | D21F 1/523 | 162/374 |
| 2007/0144699 A1* | 6/2007 | McPherson | D21F 1/523 | 162/374 |

* cited by examiner

*Primary Examiner* — Jacob T Minskey
*Assistant Examiner* — Matthew M Eslami
(74) *Attorney, Agent, or Firm* — Amster, Rothstein & Ebenstein LLP

(57) ABSTRACT

A dewatering box cover including a main body having a leading edge, a trailing edge opposite the leading edge, a first edge, a second side edge opposite the first side edge, a top surface, and a bottom surface. A first slot is formed within the main body having a first portion and a second portion angled relative to the first portion so as to form a V-shape. A plurality of second slots are formed within the main body at both sides of the first slot. The second slots and the first and second portions of the first slot extend from the top surface to the bottom surface of the main body at an angle relative to horizontal of 30° to 70° and at an angle relative to vertical of 20° to 45°.

12 Claims, 4 Drawing Sheets

DEWATERING BOX COVER

RELATED APPLICATIONS

This application claims priority to and the benefit of U.S. Provisional Application No. 63/033,295, filed Jun. 2, 2020 and entitled DEWATERING BOX COVER, the contents of which are incorporated herein by reference in their entirety.

FIELD OF THE INVENTION

The present invention relates to a vacuum assisted dewatering box for use in a papermaking machine, such as, for example, a Uhle box, a felt suction box, or other type of suction box that assists in dewatering a sheet and a fabric upon which the sheet is conveyed in the papermaking machine, and in particular, this invention is directed to a dewatering box cover.

BACKGROUND OF INVENTION

During the process of making paper in a papermaking machine, a highly aqueous slurry of about 99% water and about 1% cellulosic fibers is ejected at high velocity either onto an endless moving forming fabric in a single fabric forming arrangement, or in between two converging forming fabrics in a two-fabric layout. The fabric or fabrics pass over one or more vacuum assisted dewatering boxes, typically called a suction box, in the forming section of a papermaking machine, to assist in water removal and consolidation of the slurry into a nascent sheet. Upon exiting the forming section, the newly formed sheet has a very high water content of about 75-80%, the remainder being solids. In one process, the embryonic sheet is then transferred to a press section where it contacts at least one press fabric which carries it through one or more press nips where further water is pressed from the sheet by mechanical means and into the press fabric. The press fabric passes over at least one vacuum assisted dewatering box, typically referred to as a Uhle box in the press section, where water and contamination is removed from the press fabric. The sheet, which now typically has a moisture content of about 45-35%, continues into a dryer section where the remainder of its water is removed by evaporative means.

Another fabric commonly used in through air dried (TAD) papermaking processes is an imprinting or structured fabric. Fabrics utilized in papermaking processes are typically cleaned with a shower solution that is typically removed with a dewatering box.

Vacuum assisted dewatering boxes are also utilized in other, similar continuous processes, such as in the manufacture of multi-ply boards. In these processes, the sheet is formed in layers and the fabric(s) carry the sheet through several presses where it is dewatered and eventually dried. Vacuum assisted dewatering boxes are employed in the press sections of these machines, as well, where the fabric and the product being conveyed upon it must also be dewatered, as in the papermaking process.

The vacuum assisted dewatering boxes used in papermaking and like machines have typically been provided with a ceramic cover, to resist the abrasive wear caused by the passage of the fabric and product over its surface as well as provide a smooth surface to limit abrasion to the fabric. One type of commercially available cover includes a straight slot that is assembled vertically into the cover and which extends in the cross direction (CD) across the width of the cover and across the width of the fabric. This type of cover has been effective in providing even drainage. The slot sizes range in linear machine direction (MD) width from about % inch to about 3.0 inches (1-7.5 cm). However, it has been found that this type of slot arrangement is unsatisfactory for certain reasons. When a fabric passes over the slot, the fabric is pulled down into the slot by the vacuum, which in turn creates two wear edges for the fabric and produces drag on the fabric and drive. Further, the fabric seam makes a loud popping sound as it is pulled down into and removed from the slot, which results in reduced fabric life at the seam. All this leads to additional cost to operate the machine. In other commercially available covers, the slots are replaced with vertically drilled holes. While this reduces the drag on the fabric thus reducing fabric wear and the amount of energy required, it is not optimal in terms of water removal.

It is known that one means of reducing or significantly eliminating these aforementioned deficiencies of the slot type suction box cover is to utilize a herringbone, zigzag or intermittent slot design. The term "herringbone" as used herein in connection with a suction box cover is understood to describe a discontinuous or non-linear slot opening, and this term is also commonly used in the same manner in the industry. These types of covers have been shown to be effective in reducing seam wear by providing more support for the press fabric seam as the fabric moves over the openings (see, for example, U.S. Pat. No. 2,957,522 to Gatke, EP 410556 to Hood et al., and U.S. Pat. No. 4,909,906 to Bartelmuss et al.). For the most part, these herringbone covers have not been available in a ceramic design because, among other reasons, there was not an economical means of producing them. It will be appreciated by those of skill in the art that it is extremely difficult and costly to machine these very tough ceramic materials to provide the desired herringbone type slot opening. As an alternative, a ceramic design with a serpentine cover has been used but it does not provide equal open area across the felt width.

Some suction box covers are presently molded from a plastic material, usually Ultra High Molecular Weight (UHMW) polyethylene. The slots in these covers are routed to form the herringbone or non-continuous slot. A problem with these UHMW covers is that they wear quickly on higher speed machines, resulting in increased loss of production due to the need to change the covers more frequently, and potentially increased damage to the press felts due to uneven fabric wear, particularly at the seam.

SUMMARY OF THE INVENTION

An object of the present invention is to overcome the above-mentioned problems associated with conventional suction box covers for use in a papermaking or similar machine.

Another object of the present invention is to provide a suction box cover that allows for a reduced paper manufacturing cost due to decreased strain on the papermaking machine drive system.

The present invention provides a cover for a vacuum dewatering box that includes holes and or slots that are cut, drilled, thermoformed or 3D printed at an angle. The slots may be angled at about 40° to about 50°, for example 45° relative to horizontal. The slots may all be in the same direction or may be bi-directional. The angle the hole or slot is cut through the cover may range from about 30° to about 45° relative to vertical. This described compounding of angles provides an open area on the surface of the cover for water removal that is larger than the tool utilized for creating the opening, hence, a larger dwell distance is created for the traveling fabric. A vacuum dewatering box having this type of cover is also provided. The open area is related to the vacuum capacity and the porosity of the fabric being dewatered. The cover open area for a pilot size machine may range from about 10,000 to about 25,000 $mm^2$. For commercial size machines, the cover open area may range from about 100,000 to about 160,000 $mm^2$ or about 120,000 to about 140,000 $mm^2$. The number of slots, spacing between slots, length and width and angle of the slots may vary depending on the desired open area and the size of the box cover. A preferred application for the cover of the present invention is for use in a papermaking machine or the like.

The cover is preferably formed from a material selected from the group consisting of high density polyethylene, high density polypropylene, stainless steel, and ceramic. Holes and slots may be staggered in the surface of the cover. By constructing the vacuum dewatering box cover in this manner, the high cost of machining the tough ceramic material to provide a discontinuous slot is significantly reduced, and the cover can be made economically and with a variety of opening arrangements. The vacuum dewatering box covers of the present invention find utility in the forming section of papermaking machines and the like, in the press section or in the shower station for cleaning fabrics such as forming fabrics, imprinting or structuring fabrics and the like, where they may be used as covers for Uhle boxes. The novel cover provides improved wear life due to its ceramic surface construction, and an angled slot arrangement so as to improve dewatering efficiency.

The covers may be trapezoidal, rectangular, oval, or elliptical in shape. The cover may be attached to the vacuum box by, for example, bolts, adhesive or some other mechanical fastening means, such as a T bar.

A dewatering box cover according to an exemplary embodiment of the present invention comprises: a main body having a leading edge, a trailing edge opposite the leading edge, a first side edge, a second side edge opposite the first side edge, a top surface, and a bottom surface; a first slot formed within the main body having a first portion and a second portion angled relative to the first portion so as to form a V-shape; and a plurality of second slots formed within the main body at both sides of the first slot, wherein the second slots and the first and second portions of the first slot extend from the top surface to the bottom surface of the main body at an angle relative to horizontal of 30° to 70° and at an angle relative to vertical of 20° to 45°.

In an exemplary embodiment of the invention, the second slots and the first and second portions of the first slots are angled at 39° relative to horizontal.

In an exemplary embodiment of the invention, the main body has a length measured from the first side edge to the second side edge that is 1.0 meter to 8 meter.

In an exemplary embodiment of the invention, the main body has a width measured from the leading edge to the trailing edge that is 130 mm to 170 mm.

In an exemplary embodiment of the invention, the slots provide the dewatering box cover with a total open area of 10,000 $mm^2$ to 150,000 $mm^2$.

In an exemplary embodiment of the invention, the cover is configured for attachment to a dewatering box to which vacuum is applied.

In an exemplary embodiment of the invention, the leading edge and the trailing edge extend in a cross direction, and the first slot is configured so that the apex of the V-shape is closest to the leading edge and a fabric traveling in a machine direction encounters the leading edge before the trailing edge so that the fabric is spread over the dewatering box cover towards the first and second edges.

In an exemplary embodiment of the invention, the first slot and each of the second slots extend in a machine direction in a continuous manner.

In an exemplary embodiment of the invention, the plurality of second slots comprises at least five second slots formed at one side of the first slot and at least five second slots formed at another side of the first slot.

In an exemplary embodiment of the invention, the plurality of second slots comprises at least seventy second slots formed at one side of the first slot and at least seventy second slots formed at another side of the first slot.

In an exemplary embodiment of the invention, the dewatering box cover has an open area length of 5.38 m using deckle inserts.

According to an exemplary embodiment of the present invention, a method of dewatering a fabric used in a papermaking process comprises the steps of: passing the fabric traveling in a machine direction over a dewatering box, wherein the dewatering box comprises a dewatering box cover, and the dewatering box cover comprises: a main body having a leading edge, a trailing edge opposite the leading edge, a first side edge, a second side edge opposite the first side edge, a top surface, and a bottom surface; a first slot formed within the main body having a first portion and a second portion angled relative to the first portion so as to form a V-shape, an apex of the V-shape being directed towards the leading edge; and a plurality of second slots formed within the main body, the plurality of second slots comprising a first set of second slots arranged at one side of the first slot and a second set of second slots arranged at another side of the first slot, the first set of second slots being angled so as to be parallel to the first portion of the first slot and the second set of the second slots being angled so as to be parallel to the second portion of the first slot; wherein the second slots and the first and second portions of the first slot extend from the top surface to the bottom surface of the main body at an angle relative to horizontal of 30° to 70° and at an angle relative to vertical of 20° to 45°, and wherein the dewatering box cover is positioned so that the leading edge of the dewatering box cover is upstream in the machine direction relative to the trailing edge, and the fabric traveling in the machine direction is spread towards the first and second side edges of the dewatering box cover as the fabric passes over the dewatering box cover due to the angled configuration of the first slot and the plurality of second slots.

BRIEF DESCRIPTION OF THE DRAWINGS

The present invention will be better understood when read in conjunction with the appended drawings. It should be understood, however, that the invention is not limited to the precise arrangements shown. In the drawings.

DETAILED DESCRIPTION

Figure 1:
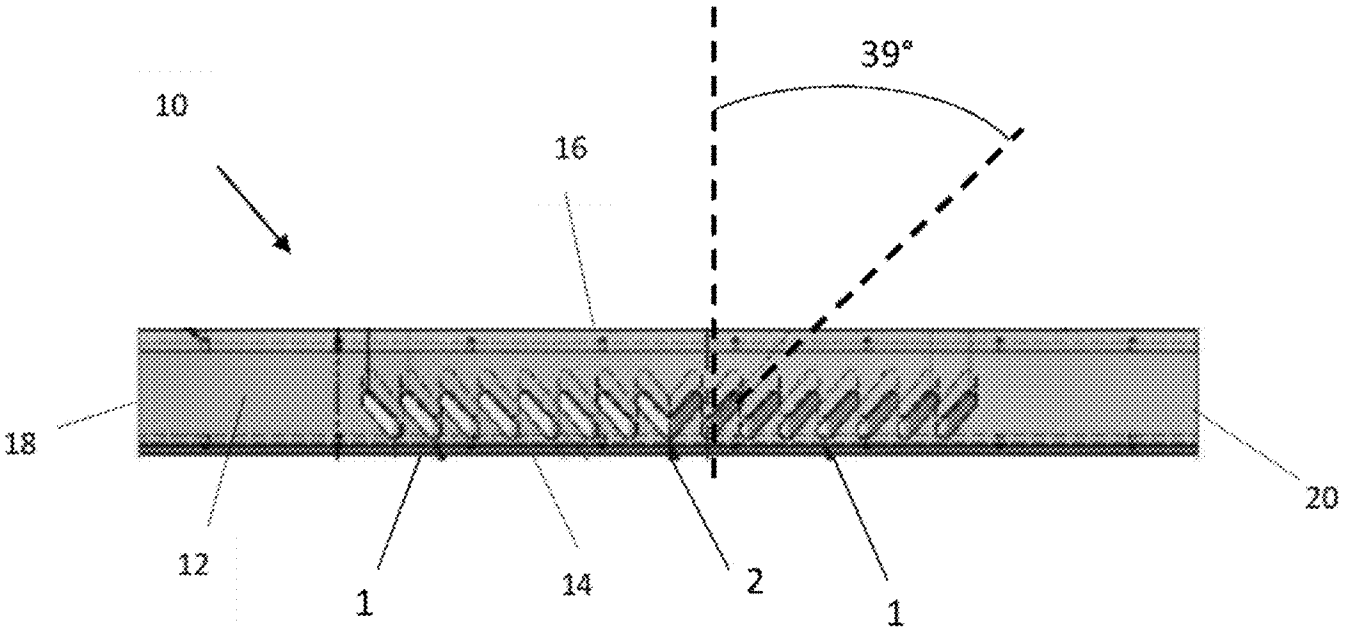
FIG. 1 is a top view of a dewatering box cover according to an exemplary embodiment of the invention.

Referring to FIG. 1, a vacuum dewatering box cover, generally designated by reference number 10, in accordance with an exemplary embodiment of the present invention is shown. The cover 10 may be used on a vacuum dewatering box used to remove moisture from a papermaking fabric or felt. Such vacuum dewatering boxes may be used as a suction box in the forming section of the papermaking machine or may be used as a Uhle box in the press section, through air drier ("TAD") section or under fabric cleaning showers. Vacuum dewatering boxes can also be used in connection with other types of dewatering or moisture removing operations and are not limited solely to the preferred use in a papermaking machine.

The cover 10 includes a main body 12 having a leading edge 14, a trailing edge 16, a first side edge 18 and a second side edge 20. The leading and trailing edges 14 and 16 extend along the length of the cover 10 and the first and second side edges 18 and 20 extend along the width of the cover 10. In exemplary embodiments, the length of the main body 12 may be in the range of 3 m to 8 m and the width of the main body may be in the range of 120 mm to 160 mm. In a specific exemplary embodiment, the length is 5.6 m and the width is 140 mm.

Figure 4:
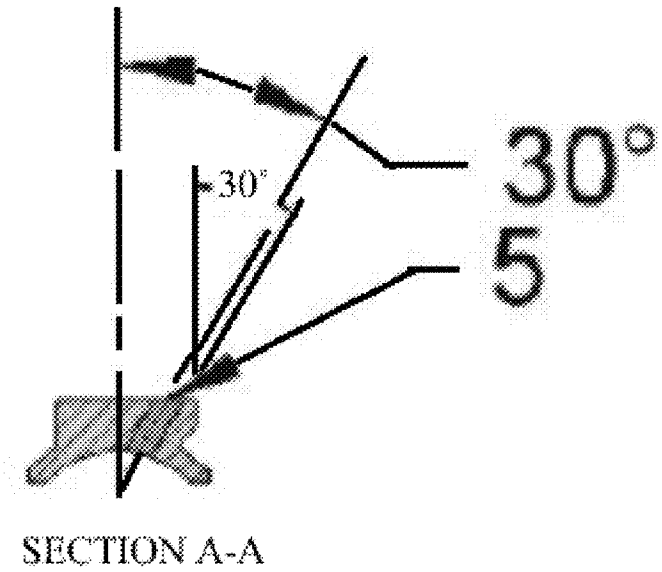
FIG. 4 is a cross-section view along line A-A of FIG. 3.
Figure 3:
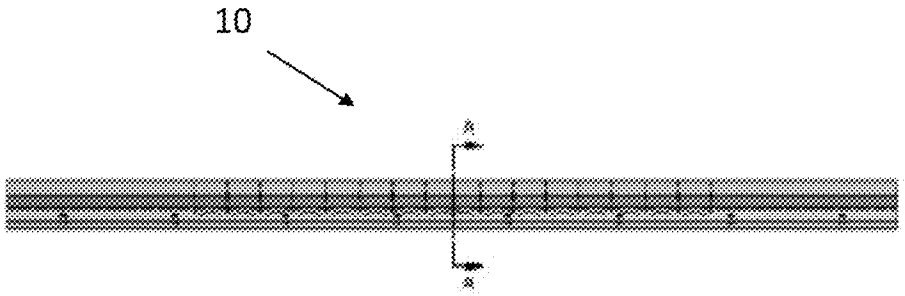
FIG. 3 is a side view of the dewatering box cover of FIG. 1.
Figure 5:
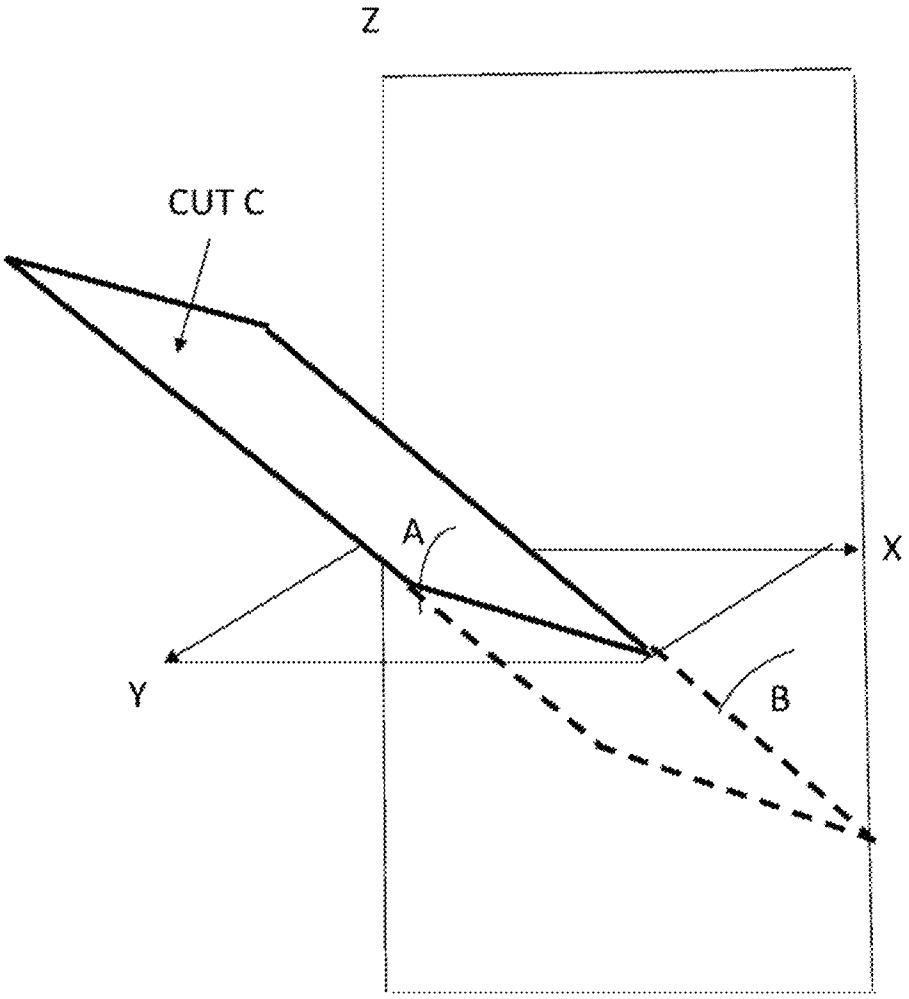
FIG. 5 is a representational diagram showing angles of a cut made through a vacuum box cover so as to form a slot in the cover in accordance with an exemplary embodiment of the present invention.

A "v" shaped center slot 2 is formed at or near the center of the top surface of the cover 10 (e.g., at or near a center line of the main body 12 that extends perpendicular to the length of the main body 12). Additional slots 1 are formed in the cover 10 adjacent to the center slot at both sides of the center slot 2. In exemplary embodiments, the center slot 2 and the additional slots 1 are formed by cutting into the material used to form the cover 10. In this regard, FIG. 5 is a representational diagram showing the angles of the Cut C, including an angle A relative to the horizontal plane X-Y and an angle B relative to the vertical plane X-Z. The angle A may be referred to as the angle relative to horizontal and the angle B may be referred to as the angle relative to vertical. As depicted by reference number 4 in FIG. 1, the arms of the center slot 2 and the slots 1 are arranged so that the angle A (i.e., the angle relative to horizontal) is 410, yielding a 390 projected angle on the top surface. This angle may vary based on the overall size of the vacuum opening. For example, the angle A may be 36.95° instead of 41°, or some other suitable value. As depicted by reference number 5 in FIG. 4, the slots extend through the thickness of the cover 10 (e.g., from the top surface to a bottom surface of the cover 10) so that the angle B (i.e., the angle relative to vertical) is 30°. It should be appreciated that the orientations of the slots 1 and 2 are not limited to the angles mentioned herein, and in other exemplary embodiments the angle A may be greater or less than 390 (e.g., 45°) and/or the angle B may be greater or less than 30°.

Without being bound by theory, it is believed that as a fabric passes over the top surface of the cover 10, the angled arrangement of the slots 1, 2 results in forces within the plane of the fabric that stretch the fabric, which in turn results in opening of the pores in the fabric. This mechanism provides for easier and more efficient removal of water from the fabric.

In exemplary embodiments, the slots 1, 2 may be angled all in one direction or may be angled in differing directions (e.g., bi-directional). The slots 1, 2 may be any shape including, but not limited to, elliptical, rectangular, trapezoidal, and the like.

Figure 2:
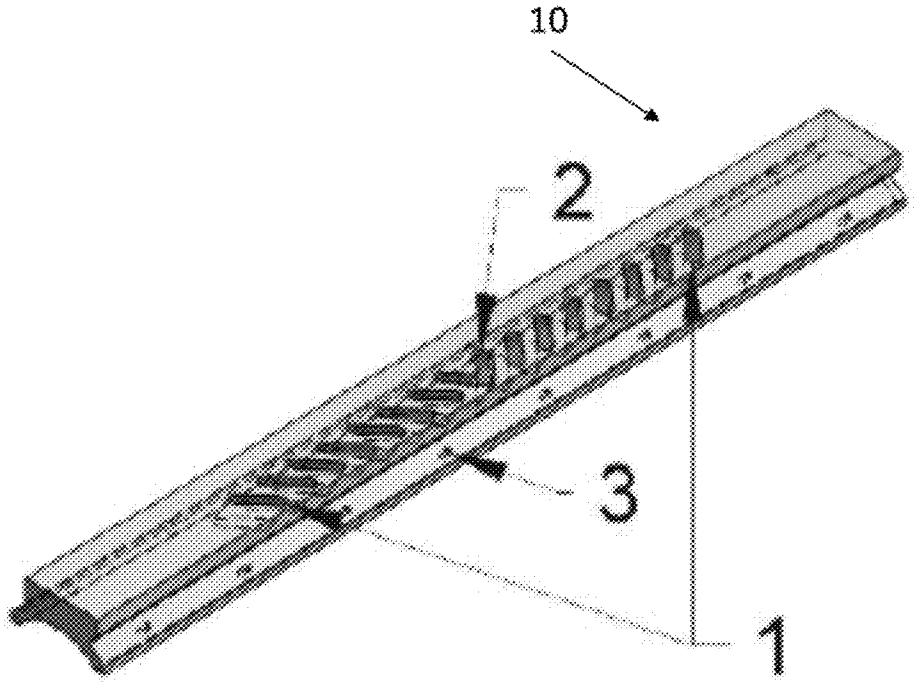
FIG. 2 is a perspective view of the dewatering box cover of FIG. 1.

In exemplary embodiments, holes 3 may be drilled through the cover 10 to accommodate screws that attach the cover to the dewatering box. As shown in FIGS. 2 and 4, the bottom surface of the vacuum dewatering box cover 10 may have an arcuate shape 6 to accommodate the vacuum box to which it is attached.

A fabric travels in direction 7 from the leading edge 14 to the trailing edge 16 of the dewatering box cover 10 such that the underside of the papermaking fabric is drawn downwardly against the top surface of the cover 10 by the vacuum force acting through the slots 1, 2 in the cover 10. In this regard, the vacuum dewatering box 10 generally extends in the cross direction and the papermaking fabric travels in the machine direction.

The cover 10 is preferably formed of a wear resistant surface material or coating. The wear-resistant material may be, for example, metal such as stainless steel or the like, a plastic such as high-density polyethylene or high-density polypropylene, or a ceramic material such as silicon nitride or aluminum oxide. It should be appreciated that the material used to form the cover 10 is not limited to the examples provided herein, and other materials may be utilized which have a high wear resistance and smooth surface characteristics. The dewatering box cover 10 may be mounted to the vacuum box using an adhesive or potting compound, drilled holes and screws, or other mechanical methods such as a T bar.

As shown in FIG. 1, in accordance with an exemplary embodiment, at least one generally longitudinally oriented slot 1 or hole is cut or drilled with an angle B of 30° into the cover 10. The shape and size of the at least one slot is determined by the desired open area for the permeability of the fabric and the amount of vacuum used. The permeability of a conventional fabric typically ranges from 200 to 700 cubic feet per minute. The cover 10 may have a rectangular shape, with the slots arranged equally spaced apart. In exemplary embodiments, the spacing, size and/or shapes of the slots may vary. For example, and without limitation, the slots may be 45 mm long and 17 mm wide. The minimum number of slots required will be a function of the amount of vacuum needed (open area) and the cover geometry. The angle A of the slots and their size may be optimized to assure acceptable open area and an outward driving force to spread the fabric. The vertical angle B of the slots may be optimized to utilize centrifugal force from the water being released from a moving fabric.

The following Example illustrates advantages of the present invention. The dimensions, process parameters and other values set forth in the Example are not intended to be limiting to the present invention.

Moisture Content Test Method

The moisture test was conducted with an L&W Moisture Tester with microwave sensor, available from ABB Ltd., Zurich, Switzerland. The procedure is to press the moisture meter against the fabric after the dewatering box in direction of the fabric travel and depress the test button on the handle and depress it again to stop and record the reading in gsm.

EXAMPLE

A dewatering box cover of FIG. 1 was made from high density polyethylene. The dewatering box cover had the same configuration as shown in FIGS. 1-4. This box cover was made for use on a pilot scale papermaking machine and was named the "FQT V-max" cover. The desired open area was calculated to be 15,000 $mm^2$. The length of the cover was 1.2 m. The width of the cover was 140 mm (fabric contact width being 107.35 mm). The length of each slot was 45 mm. The width of each slot was 17 mm. All slots were formed with 30° angle cuts relative to vertical (angle B=30°). The cover had a V-shaped slot in the center of the cover, with both arms of the V at 45° relative to one another on the 30° plane relative to horizontal projected through the cover. Seven slots were formed in the cover, each adjacent the next with the slots aligned to the left of the V. An addition, seven slots, each adjacent to the next were aligned to the right of the V. The slots had an angle A (relative to horizontal) of 39°. The cover was attached to a dewatering box of a through air dried fabric cleaning station. The box had vacuum applied to assist in water removal. Water was removed through the box and drained to a save all. As a fabric with water passed over the dewatering box cover from leading edge to trailing edge, the combination of vacuum and the design of the box cover stretched out the fabric, thereby increasing the pore size in the fabric and facilitating water removal at lower cost. The moisture content in the fabric after the dewatering box was 8% to 12% lower with the FQT V-Max cover than the two slotted box cover and the dispersed holes cover which had equal open areas to the FQT V-Max cover. The two slotted box cover and the dispersed holes cover can be purchased from IBS Of America Corp., 3732 Profit Way, Chesapeake, VA, USA 23323. The commercial names for these covers are "Two-Slotted Dewatering Box Cover" and "Press Master Dewatering Box Cover", respectively. With the same fabric on the paper machine (composite laminated belt at 30×7 mesh and count, with 350 cfm, and a vacuum of 25 kpa at the dewatering box), the FQT V-Max resulted in a drier exiting moisture content of 90 grams per square meter (gsm) as compared to 98 gsm for the dispersed holes box and 102 gsm for the two slotted box cover.

It should be appreciated that the dewatering box cover in accordance with exemplary embodiments of the present invention is not limited to the specific configuration previously described with reference to FIGS. 1-4. For example, the dewatering box cover may be made from several different materials including high density polyethylene, ceramics and glass reinforced plastic, and combinations thereof. In a specific alternative exemplary embodiment, the dewatering box cover may have the following properties: an open area of approximately 129.363 $mm^2$; a length of 5.74 m; a width of 161.12 mm (fabric contact width being 155.12 mm); length of each slot is 61.71 mm; width of each slot is 13.76 mm; slots formed with 30° angle cuts relative to vertical (i.e., angle B=30°); a V-shaped slot in the center, with both arms of the V at 73.9 degrees relative to one another on the 30° plane relative to horizontal projected through the cover; seventy nine slots formed in the cover, each adjacent to the next and aligned to the left of the V; seventy nine additional slots formed in the cover, each adjacent to the next and aligned to the right of the V; and slots formed with 36.95° angle cuts relative to horizontal (i.e., angle A=36.95°).

The size of the box cover, number of slots, spacing between the slots, open area and size and angle of the slots may all vary on a larger, commercial scale papermaking machine. The number of slots, size of slots, etc. can be extrapolated from the teaching above with a directional limitation. In other words, slots to one side of the central V can be extrapolated based on overall size of the cover and box. Slots on the other side of the V would be extrapolated separately.

It should also be appreciated that the open area may be varied using deckle inserts, which are non-permeable plastic pieces that can be manually moved inward from the front or tending side of the machine or the back or drive side of the machine. The positions of the deckle inserts can be adjusted to close down the cross direction width of the open area of the dewatering box to a width marginally wider than the sheet width. For example, with a sheet width of 5.33 m, the deckle inserts would be moved in to reduce the dewatering box width from full width of 5.60 m to a width of 5.38 m, which is 0.05 m wider than the sheet width, or 0.025 m wider on the front side and 0.025 m wider on the back side.

Now that embodiments of the present invention have been shown and described in detail, various modifications and improvements thereon can become readily apparent to those skilled in the art. Accordingly, the exemplary embodiments of the present invention, as set forth above, are intended to be illustrative, not limiting. The spirit and scope of the present invention is to be construed broadly.

The invention claimed is:

1. A dewatering box cover comprising:

a main body having a leading edge, a trailing edge opposite the leading edge, a first side edge, a second side edge opposite the first side edge, a top surface, and a bottom surface, the top and bottom surfaces defining a thickness of the main body;

a first slot extending through the thickness of the main body, the first slot having a first portion and a second portion angled relative to the first portion so as to form a V-shape; and a plurality of second slots formed at both sides of the first slot and extending through the thickness of the main body;

wherein the second slots and the first and second portions of the first slot extend from the top surface to the bottom surface through the thickness of the main body at an angle relative to horizontal of 30° to 70° and at an angle relative to vertical of 20° to 45°, wherein the angle relative to horizontal and the angle relative to vertical of the second slots and the first and second portions of the first slot provides an open area on the top surface of the cover that provides a larger, continuous dwell distance for translating fabric moving relative to the cover as compared to a dewatering box cover with vertically-cut holes.

2. The dewatering box cover of claim 1, wherein the second slots and the first and second portions of the first slots are angled at 39° relative to horizontal.

3. The dewatering box cover of claim 1, wherein the main body has a length measured from the first side edge to the second side edge that is 1.0 meter to 8 meter.

4. The dewatering box cover of claim 1, wherein the main body has a width measured from the leading edge to the trailing edge that is 130 mm to 170 mm.

5. The dewatering box cover of claim 1, wherein the slots provide the dewatering box cover with a total open area of 10,000 $mm^2$ to 150,000 $mm^2$.

6. The dewatering box cover of claim 1, wherein the cover is configured for attachment to a dewatering box to which vacuum is applied.

7. The dewatering box cover of claim 1, where the leading edge and the trailing edge extend in a cross direction, and the first slot is configured so that the apex of the V-shape is closest to the leading edge and a fabric traveling in a machine direction encounters the leading edge before the trailing edge so that the fabric is spread over the dewatering box cover towards the first and second edges.

8. The dewatering box cover of claim 7, where the first slot and each of the second slots extend in a machine direction in a continuous manner.

9. The dewatering box cover of claim 1, wherein the plurality of second slots comprises at least five second slots formed at one side of the first slot and at least five second slots formed at another side of the first slot.

10. The dewatering box cover of claim 1, wherein the plurality of second slots comprises at least seventy second slots formed at one side of the first slot and at least seventy second slots formed at another side of the first slot.

11. The dewatering box cover of claim 1, wherein the dewatering box cover has an open area length of 5.38 m.

12. A method of dewatering a fabric used in a papermaking process, comprising the steps of:

passing the fabric traveling in a machine direction over a dewatering box, wherein the dewatering box comprises a dewatering box cover, and the dewatering box cover comprises:

a main body having a leading edge, a trailing edge opposite the leading edge, a first side edge, a second side edge opposite the first side edge, a top surface, and a bottom surface, the top and bottom surfaces defining a thickness of the main body;

a first slot extending through the thickness of the main body, the first slot having a first portion and a second portion angled relative to the first portion from the trailing edge to the leading edge so as to form a V-shape, an apex of the V-shape being directed towards the leading edge; and a plurality of second slots extending through the thickness of the main body, the plurality of second slots comprising a first set of second slots arranged at one side of the first slot and a second set of second slots arranged at another side of the first slot, the first set of second slots being angled so as to be parallel to the first portion of the first slot and the second set of the second slots being angled so as to be parallel to the second portion of the first slot;

wherein the second slots and the first and second portions of the first slot extend from the top surface to the bottom surface through the thickness of the main body at an angle relative to horizontal of 30° to 70° and at an angle relative to vertical of 20° to 45°, and wherein the dewatering box cover is positioned so that the leading edge of the dewatering box cover is upstream in the machine direction relative to the trailing edge, and the fabric traveling in the machine direction is spread towards the first and second side edges of the dewatering box cover as the fabric passes over the dewatering box cover due to the angled configuration of the first slot and the plurality of second slots, and wherein the angle relative to horizontal and the angle relative to vertical of the second slots and the first and second portions of the first slot provides an open area on the top surface of the cover that provides a larger, continuous dwell distance for the fabric moving relative to the cover as compared to a dewatering box cover with vertically-cut holes.

* * * * *